US010046443B2

(12) United States Patent
Sun et al.

(10) Patent No.: US 10,046,443 B2
(45) Date of Patent: Aug. 14, 2018

(54) RATCHET STRUCTURE FOR SCREWDRIVER

(71) Applicant: CIXI CHENGJIA HARDWARE TOOLS CO., LTD., Cixi, Zhejiang (CN)

(72) Inventors: Chenggang Sun, Zhejiang (CN); Quan Song, Zhejiang (CN)

(73) Assignee: Cixi Chengjia Hardware Tools Co., Ltd., Cixi, Zhejiang (CN)

( * ) Notice: Subject to any disclaimer, the term of this patent is extended or adjusted under 35 U.S.C. 154(b) by 108 days.

(21) Appl. No.: 15/242,519

(22) Filed: Aug. 20, 2016

(65) Prior Publication Data

US 2017/0100821 A1 Apr. 13, 2017

(30) Foreign Application Priority Data

Oct. 8, 2015 (CN) ..... 2015 2 0772789 U

(51) Int. Cl.
*B25B 15/04* (2006.01)
*B25B 23/00* (2006.01)

(52) U.S. Cl.
CPC ..... *B25B 15/04* (2013.01); *B25B 23/0035* (2013.01)

(58) Field of Classification Search
CPC ..... B25B 15/04; B25B 17/02
USPC ..... 81/57.3
See application file for complete search history.

(56) References Cited

U.S. PATENT DOCUMENTS 4,846,027 A * 7/1989 Lu ..... B25B 15/02 81/57.3
5,125,297 A * 6/1992 Bai ..... B60B 29/005 81/57.3
5,406,866 A * 4/1995 Badiali ..... B25B 15/02 81/57.3
5,651,294 A * 7/1997 Shiao ..... B25B 13/462 81/59.1
6,035,746 A * 3/2000 Lin ..... B25B 13/467 81/57.14
9,216,496 B2 * 12/2015 Gauthier ..... B25B 17/02

* cited by examiner

*Primary Examiner* — Hadi Shakeri
(74) *Attorney, Agent, or Firm* — Lei Fang & Associates LLC; Lei Fang, Esq.

(57) ABSTRACT

A ratchet structure for a screwdriver, comprising a ratchet body and a toothed shaft having a segment of a toothed outer surface, wherein a ratchet speed multiplier mechanism which is fitted with the ratchet body and allows the toothed shaft to have a multiplied speed is also sleeved outside the toothed shaft. The ratchet structure has a reasonable structure and the screwdriver exhibits good braking effect, so that the toothed shaft can be rotated at a 5× speed. In this way, the speed for screwing a screw is greatly increased and it is more manpower-saving.

8 Claims, 4 Drawing Sheets

RATCHET STRUCTURE FOR SCREWDRIVER

CROSS-REFERENCE TO RELATED APPLICATIONS

This application claims benefit and priority to Chinese patent application No. 201520772789.2, which was filed on Oct. 8, 2015, the entire content of which is hereby incorporated by reference herein.

TECHNICAL FIELD

The present application relates to a ratchet structure for a screwdriver.

BACKGROUND

Screwdrivers, as common hardware, are used for fastening or unscrewing screws. The existing screwdrivers generally mainly consist of a handle, a bar and a tip. A user rotates the handle to drive the bar and the tip to rotate. In this way, a screw is fastened or unscrewed by driving the screw by the tip to rotate. However, the rotation of such screwdrivers depends completely on manpower, it is manpower-consuming to use and also difficult to control the direction. Gyration might be caused during the rotation, thus making it more inconvenient to use.

To overcome the defects above, there are some ratchet screwdrivers capable of idling in a single direction. For example, in Chinese Pat. No. 201020222335.5 titled "RATCHET SCREWDRIVER", the ratchet screwdriver includes a ratchet rod, a hollow control rod and a sleeve; a front portion of the ratchet rod is a cavity connecting a tip of an external screwdriver, a middle portion is a ratchet component, and a rear portion is a connecting portion; a front portion of the control rod has a projecting portion, and a rear portion thereof is a connecting rod; the connecting rod of the ratchet rod and the ratchet component are inserted into the control rod and located at the projecting portion and the connecting rod respectively, the ratchet component is partially surrounded by the projecting portion, and the ratchet rod can be inside the control rod and rotate with respect to the control rod; and the sleeve is sleeved outside the projecting portion and the ratchet component to form a ratchet mechanism for controlling the idling in a single direction and locking of the screwdriver. However, this ratchet screwdriver rotates at a 1× speed, and is thus less manpower-saving.

In Chinese Pat. No. 201310505585.8 titled "RATCHET SCREWDRIVER ROTATING AT A MULTIPLIED SPEED", the screwdriver handle includes a tip, a handle, an extension rod, a ratchet device and a multiplied rotation device; the ratchet device includes a ratchet body, a ratchet ring, a ratchet roll pin and a hollow shaft; the multiplied rotation device includes a gear seat, a clutch gear, a big planetary gear and an external housing, and the ratchet device and the multiplied rotation device are connected by a gear shaft; and the ratchet device is fixedly arranged on the handle, one end of the extension rod is fixedly connected to the gear shaft, and the tip is fixedly arranged at the other end of the extension rod. Since such a screwdriver handle can transfer a multiplied rotation speed, the speed for screwing a screw is greatly increased. It can be designed to rotate at a 4× speed as the existing multiplied ratchet screwdrivers. However, since gears 13-14 as shown in the drawing are all idler gears which do not rotate with the handle, such a screwdriver can rotate at a 4× speed to the maximum; and if this screwdriver is designed with a higher speed, for example, a 5× speed, it is necessary to expand the overall external diameter of the ratchet structure, and in doing so, it is inconvenient to carry and use such a screwdriver. This screwdriver is not ideal in the structural design. At present, there is no report about a ratchet screwdriver that rotates at a speed higher than 4×.

SUMMARY

The technical problem to be solved by the present application is to provide a ratchet structure for a screwdriver with a reasonable structure, good braking effect, and a toothed shaft capable of rotating at a higher speed.

The present application employs the following technical solutions to solve the technical problem: a ratchet structure for a screwdriver is provided, including a ratchet body and a toothed shaft having a segment of a toothed outer surface, the ratchet body being sleeved on the toothed shaft, a curved cavity having a cross-section which is a triangle with curved sides being molded inside the ratchet body, a steering component being provided inside the curved cavity, the steering component being arranged inside the curved cavity by a positioning mechanism in such a way of being rotatably positioned leftward and rightward, the lower portion of the steering component having a cylindrical structure, three positioning slots corresponding to three surfaces of the triangle with curved sides of the curved cavity being formed on the cylindrical structure in an axial direction, a clamping column being respectively provided inside each positioning slot with an inner side of the clamping column being fitted with and resisted against an outer circumference of the toothed shaft and an outer side of the clamping column being exposed from the positioning slots to be fitted with an inner wall of the curved cavity for purpose of limiting, when the steering component is rotated, one clamping column being turned to be resisted against the curved cavity of the ratchet body, the clamping column being tightly resisted against the toothed shaft inward to allow the toothed shaft to rotate in an opposite direction, wherein a ratchet speed multiplier mechanism which is fitted with the ratchet body and allows the toothed shaft to have a multiplied speed is also sleeved outside the toothed shaft; and the ratchet speed multiplier mechanism includes a ratchet speed multiplier casing and three planetary gears, the ratchet speed multiplier casing is sleeved on the toothed shaft and arranged above a steering switch in a couple matched manner, a toothed surface engaged with the three planetary gears is provided annularly on an inner side of the ratchet speed multiplier casing, the three planetary gears are rotatably arranged on the ratchet speed multiplier casing by a positioning pin, and one end of the planetary gear is engaged with teeth on the toothed shaft and the other end thereof is engaged with the ratchet speed multiplier casing.

As an improvement, a center hole for the positioning pin to pass through is formed on the planetary gear, a positioning hole into which a lower end of the positioning pin is inserted is formed on an inner wall of the curved cavity of the ratchet body, a curved slot for the positioning pin to pass through and rotate therein is formed on an upper surface of the steering switch, triangular spacers are provided at an upper end and a lower end of the planetary gear respectively, and the positioning pin passes through the upper spacer, the center hole on the planetary gear, the lower spacer and the curved hole of the steering switch to be inserted into the positioning hole.

As a further improvement, a first annular groove is provided in a toothed middle portion of the toothed shaft, the planetary gears are provided below the first annular groove, and a first snap ring fitted with and resisted against an upper end of the ratchet speed multiplier casing is provided inside the first annular groove.

As a further improvement, a second annular groove is provided at an end portion of a smooth segment of the toothed shaft, and a second snap ring fitted with and resisted against a lower end of the ratchet body is provided inside the second annular groove.

As a further improvement, the steering component has a disc-like upper portion, and a circular stepped groove for embedding the upper portion of the steering component is provided at an upper end of the curved cavity of the ratchet body; the positioning mechanism includes a steel ball, a blind hole is formed on an outer surface of the disc-like upper portion of the steering component, and the steel ball is protruded from the blind hole and embedded on the steering component; two positioning grooves matched with the steel ball are provided on an inner wall of the circular stepped groove of the ratchet body, a spring which renders the steel ball always in an outward trend is provided between the bottom of the blind hole and the steel ball; and when the steering component is rotated and the steel ball is located in a positioning groove at a left side or a right side, the clamping column is tightly resisted against the toothed shaft, and the toothed shaft rotates in a single direction clockwisely or counterclockwisely respectively.

As a further improvement, a steering switch for controlling the rotation of the steering component is provided on the steering component, the steering switch has a ferrule-like structure, and the steering switch is sleeved outside the ratchet body to connect with the steering component.

As an improvement, three sectored clamping holes are provided on an upper surface of the upper portion of the steering component, a clamping pin fitted with the sectored clamping hole is provided at and protruded from a lower end of the steering switch, and the steering switch is clamped with the steering component by the fitting between the clamping pin and the sectored clamping hole.

As an improvement, an arrow mark for steering is provided on an outer side of the steering switch.

Finally, a toothed upper end of the toothed shaft is connected to an extension rod in interference fit.

Compared with the prior art, the present application has the following advantages. The product is reasonable in structure: the steering component is controlled to rotate by the steering switch, while the clamping column is driven to rotate by the rotation of the steering component, and the distance between the toothed shaft and the ratchet body allows the clamping column to rotate only in one direction so as to control the direction of the toothed shaft. The ratchet speed multiplier mechanism is provided so that the toothed shaft can rotate for a plurality of turns when the ratchet body rotates for one turn according to the operating principle of a planetary gear. In particular, the three planetary gears, while serving as the idler gears, can rotate with the handle along the planetary casing outside, so that another 1× speed is provided. Accordingly, under the same conditions, the speed is higher. The ratchet structure for a screwdriver of the present application has a reasonable structure and the screwdriver exhibits good braking effect. Under the same conditions, the toothed shaft can rotate at a speed increased by 1×. In this way, the speed for screwing a screw is greatly increased, and it is manpower-saving to use. Meanwhile, ratchet structure for a screwdriver of the present application is stable in operation and reliable in performance, and the production efficiency is thus effectively improved.

DETAILED DESCRIPTION

The present application will be further described in detail below with reference to the accompanying drawings by embodiments.

Figure 1:
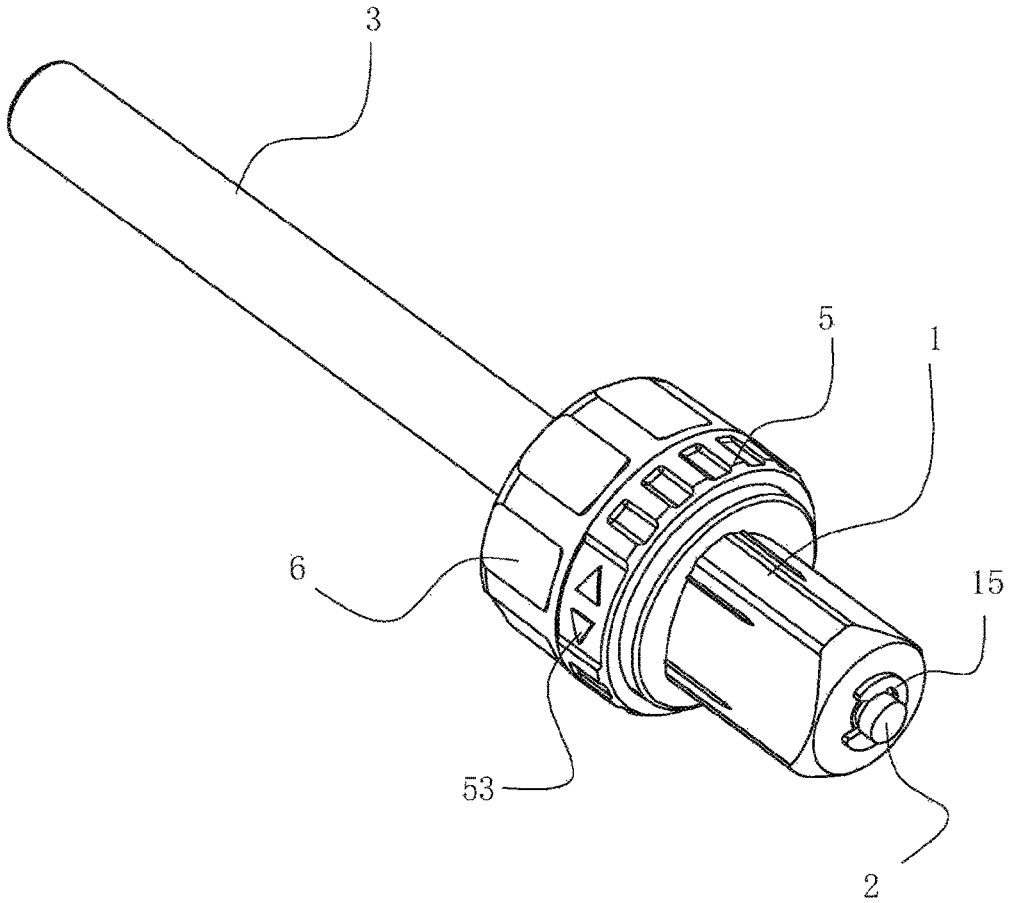
FIG. 1 is a schematic structure diagram of the present application.
Figure 2:
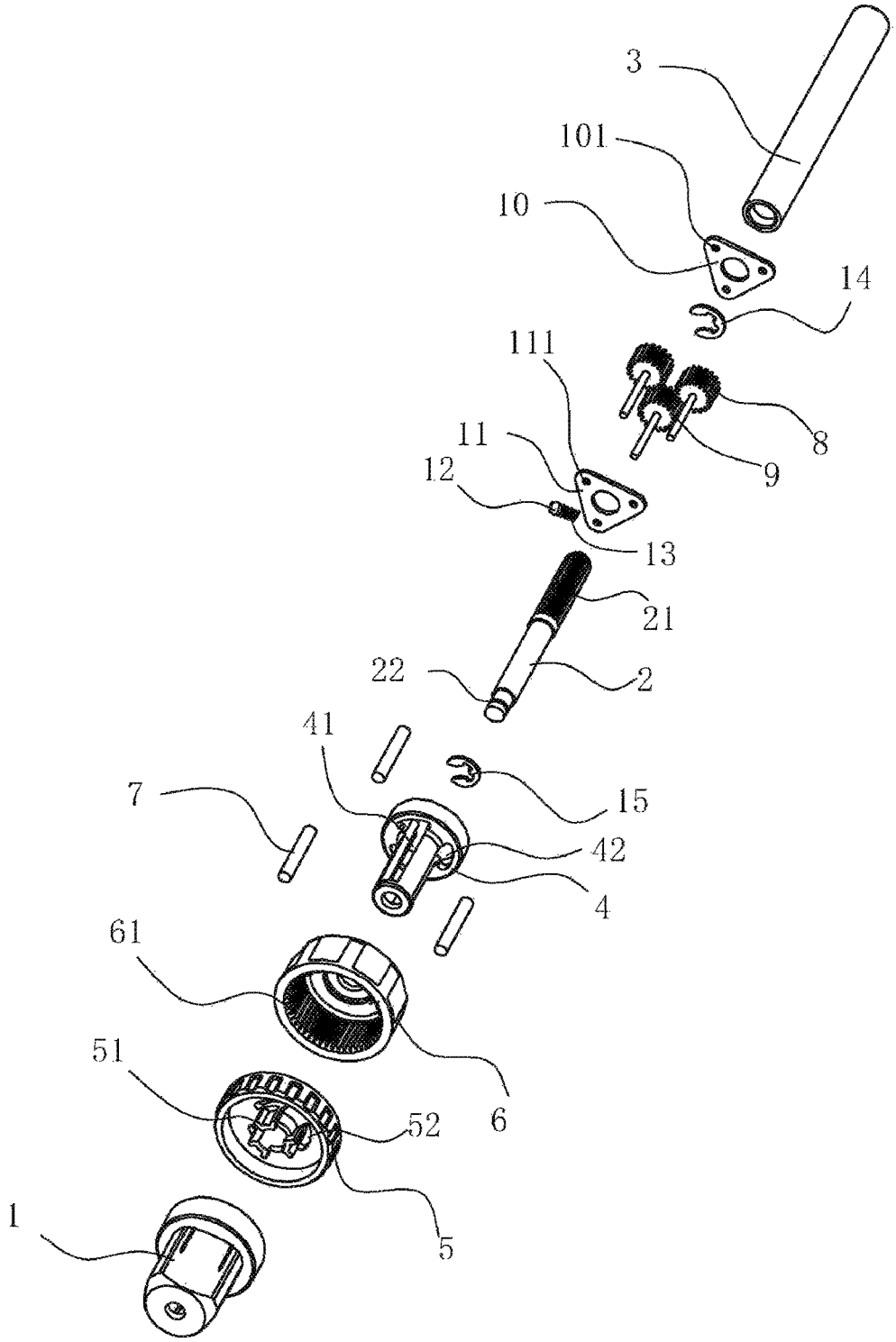
FIG. 2 is an exploded structure diagram of the present application.
Figure 3:
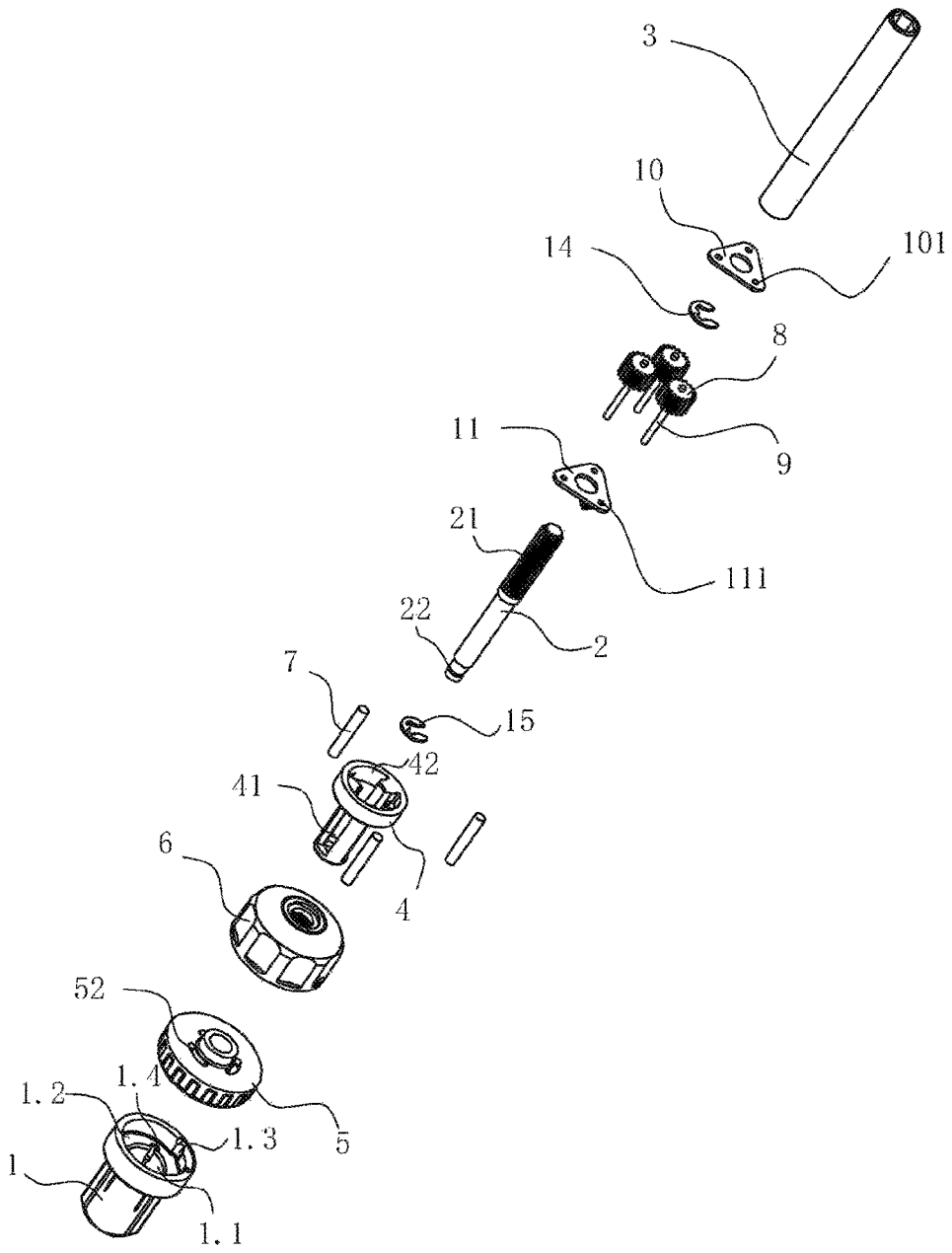
FIG. 3 is an exploded structure diagram of the present application from another angle.
Figure 4:
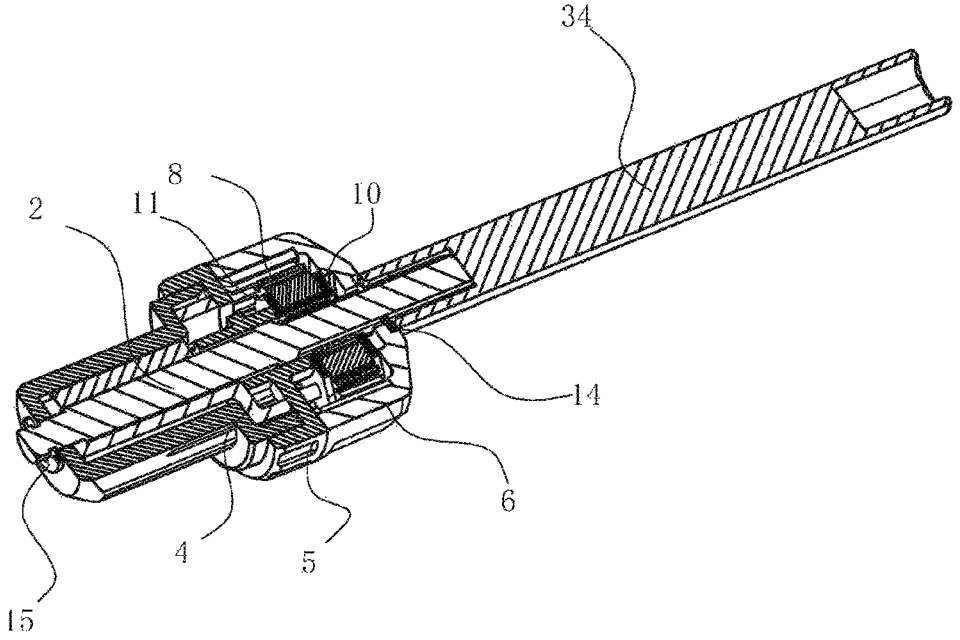
FIG. 4 is a cutaway view of the structure of the present application in an axial direction.
Figure 5:
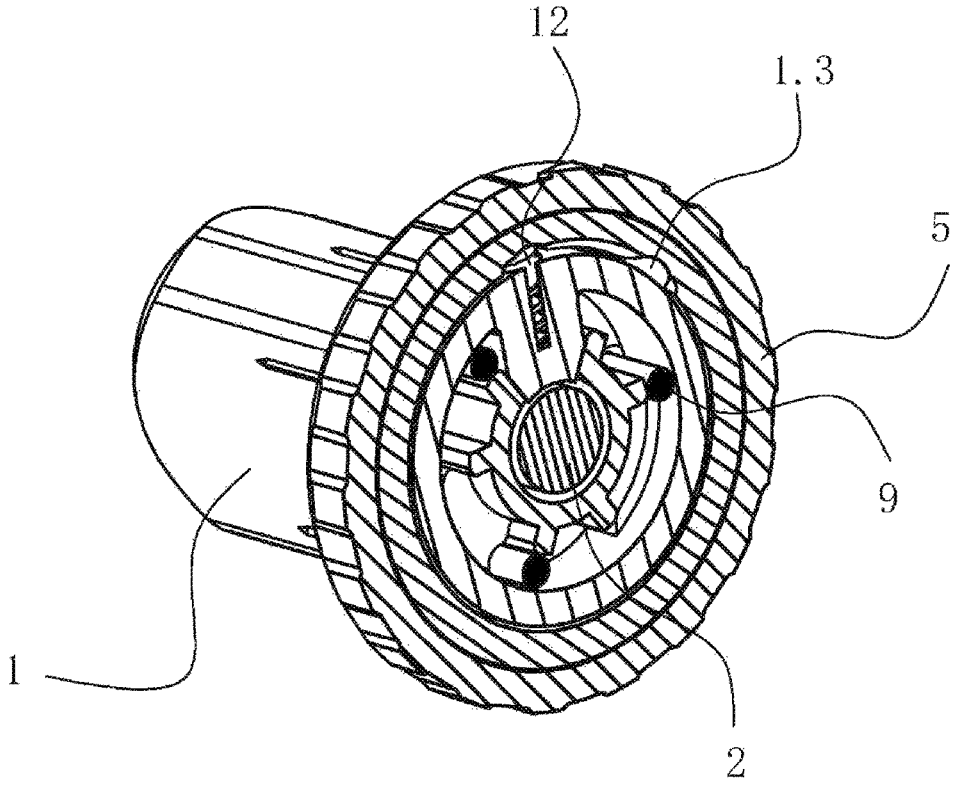
FIG. 5 is a cutaway view of the structure of the present application in a horizontal direction.

As shown in FIGS. 1 to 4, a ratchet structure for a screwdriver of this embodiment is provided, including a ratchet body 1, a toothed shaft 2, an extension rod 3, a steering component 4, a steering switch 5 and a ratchet speed multiplier mechanism; the ratchet body 1 is generally fixed on a handle; the toothed shaft 2 has a segment of a toothed outer surface, a toothed upper end of the toothed shaft 2 is connected to the extension rod 3 in interference fit; the ratchet body 1 is sleeved on the toothed shaft 2, and a curved cavity 1.1 having a cross-section which is a triangle with curved sides is molded inside the ratchet body 1; the steering component 4 is arranged inside the curved cavity 1.1 by a positioning mechanism in such a way of being rotatably positioned leftward and rightward, and the lower portion of the steering component 4 has a cylindrical structure and the upper portion thereof is disc-like; a circular stepped groove 1.2 for embedding the disc-like upper portion of the steering component 4 is provided at an upper end of the curved cavity 1.1 of the ratchet body 1; three positioning slots 41 corresponding to three surfaces of the triangle with curved sides of the curved cavity 1.1 are formed on the cylindrical structure of the steering component 4 in an axial direction, a clamping column 7 is respectively provided inside each positioning slot 41 with an inner side of the clamping column 7 being fitted with and resisted against an outer circumference of the toothed shaft 2 and an outer side of the clamping column 7 being exposed from the positioning slots 41 to be fitted with an inner wall of the curved cavity 1.1 for purpose of limiting, thus the ratchet structure is formed. The foregoing structures are similar to traditional ones, with consistent basic principles. The positioning mechanism includes a steel ball 12, a blind hole is formed on an outer surface of the disc-like upper portion of the steering component 4, the steel ball 12 is protruded from the blind hole and embedded on the steering component 4, and two positioning grooves 1.3 matched with the steel ball 12 are provided on and recessed into an inner wall of the circular stepped groove 1.2 of the ratchet body 1. A spring 13 which renders the steel ball 12 always in an outward trend is provided between the bottom of the blind hole and the steel ball 12. The steering switch 5 has a ferrule-like structure, and the steering switch 5 is sleeved outside the ratchet body 1 to connect with the steering component 4 for controlling the rotation of the steering component 4. Three sectored clamping holes 42 are formed on an upper surface of the upper portion of the steering component 4, a clamping pin 51 fitted with the sectored clamping hole 42 is provided at and protruded from a lower end of the steering switch 5, and the steering switch 5 is clamped with the steering component 4 by the fitting between the clamping pin 51 and the sectored clamping hole 42. An arrow mark 53 for steering is provided on an outer side of the steering switch 5.

When the steering switch 5 rotates clockwise, the steering component 4 is driven to rotate clockwise, and the clamping column 7 rotates together with the steering component 4. The steel ball 12 is located in the positioning groove 1.3 on the right side. One clamping column 7 is resisted against an inner wall of the curved cavity 1.1 of the ratchet body 1 for the purpose of limiting. The clamping column 7 is tightly resisted against the toothed shaft 2 so that the toothed shaft 2 can rotate counterclockwise in a single direction. When the steering switch 5 rotates counterclockwise, the steering component 4 is driven to rotate counterclockwise. The steel ball 12 is located in the positioning groove 1.3 on the left side. Another clamping column 7 is resisted against the inner wall of the curved cavity 1.1 of the ratchet body 1 for the purpose of limiting. The clamping column 7 is tightly resisted against the toothed shaft 2 so that the toothed shaft 2 can rotate clockwise in a single direction.

The ratchet speed multiplier mechanism includes a ratchet speed multiplier casing 6 and three planetary gears 8. The ratchet speed multiplier casing 6 is sleeved on the toothed shaft 2 and arranged above the steering switch 5 in a couple matched manner, a toothed surface 61 engaged with the three planetary gears 8 is provided annularly on an inner side of the ratchet speed multiplier casing 6, the three planetary gears 8 are rotatably arranged inside the ratchet speed multiplier casing 6 by a positioning pin 9, and one end of each of the planetary gears 8 is engaged with teeth on the toothed shaft 2 and the other end thereof is engaged with the toothed surface 61 of the ratchet speed multiplier casing 6. A center hole for the positioning pin 9 to pass through is formed on each of the planetary gears 8, a positioning hole 1.4 into which a lower end of the positioning pin 9 is inserted is formed on an inner wall of the curved cavity 1.1 of the ratchet body 1, and a curved slot 52 for the positioning pin 9 to pass through and rotate therein is formed on an upper surface of the steering switch 5. A triangular upper spacer 10 and a triangular lower spacer 11 are respectively arranged at the upper end and the lower end of the planetary gear 8, and a through-hole 101 and a through-hole 111 for the positioning pin 9 to pass through are formed on a triangular edge of the upper spacer 10 and the lower spacer 11.

The positioning pin 9 passes through the through-hole 101 of the upper spacer 10, the center hole of the planetary gear 8, the through-hole 111 of the lower spacer 11 and the curved hole 52 of the steering switch 5 to be inserted into the positioning hole 1.4. A first annular groove 21 is provided in a toothed middle portion of the toothed shaft 2, the planetary gears 8 are provided below the first annular groove 21, and a first snap ring 14 fitted with and resisted against an upper end of the ratchet speed multiplier casing 6 is provided inside the first annular groove 21. A second annular groove 22 is provided at an end portion of a smooth segment of the toothed shaft 2, and a second snap ring 15 fitted with and resisted against a lower end of the ratchet body 1 is provided inside the second annular groove 22.

In this way, when the ratchet body 1 is butt-jointed with the ratchet speed multiplier casing 6, the ratchet body 1 is connected to the toothed shaft 2 by the first snap ring 14 and the second snap ring 15. According to the operating principle of the planetary gears 8, a 4× speed between the ratchet speed multiplier casing 6 and the toothed shaft 2 can be achieved. Since the planetary gears 8 are fixed on the ratchet body 1 by the positioning pin 9, when the ratchet body 1 rotates for one turn, the planetary gears 8 rotate for the same. Added with the speed at which the planetary gears 8 rotate along the ratchet speed multiplier casing 6, a speed at which the toothed shaft 2 rotates for five turns when the ratchet body 1 rotates for one turn is realized.

The invention claimed is:

1. A ratchet structure for a screwdriver, comprising a ratchet body and a toothed shaft having a segment of a toothed outer surface, the ratchet body being sleeved on the toothed shaft, a curved cavity having a cross-section which is a triangle with curved sides being molded inside the ratchet body, a steering component being provided inside the curved cavity, the steering component being arranged inside the curved cavity by a positioning mechanism in such a way of being rotatably positioned leftward and rightward, the lower portion of the steering component having a cylindrical structure, three positioning slots corresponding to three surfaces of the triangle with curved sides of the curved cavity being formed on the cylindrical structure in an axial direction, a clamping column being respectively provided inside each positioning slot with an inner side of the clamping column being fitted with and resisted against an outer circumference of the toothed shaft and an outer side of the clamping column being exposed from the positioning slots to be fitted with an inner wall of the curved cavity for purpose of limiting, when the steering component is rotated, one clamping column being turned to be resisted against the curved cavity of the ratchet body, the clamping column being tightly resisted against the toothed shaft inward to allow the toothed shaft to rotate in an opposite direction, wherein a ratchet speed multiplier mechanism which is fitted with the ratchet body and allows the toothed shaft to have a multiplied speed is also sleeved outside the toothed shaft; and the ratchet speed multiplier mechanism comprises a ratchet speed multiplier casing and three planetary gears, the ratchet speed multiplier casing is sleeved on the toothed shaft and arranged above a steering switch in a couple matched manner, a toothed surface engaged with the three planetary gears is provided annularly on an inner side of the ratchet speed multiplier casing, the three planetary gears are rotatably arranged on the ratchet speed multiplier casing by a positioning pin, and one end of the planetary gear is engaged with teeth on the toothed shaft and the other end thereof is engaged with the ratchet speed multiplier casing;

wherein a center hole for the positioning pin to pass through is formed on the planetary gear, a positioning hole into which a lower end of the positioning pin is inserted is formed on an inner wall of the curved cavity of the ratchet body, a curved slot for the positioning pin to pass through and rotate therein is formed on an upper surface of the steering switch, triangular spacers are provided at an upper end and a lower end of the planetary gear respectively, and the positioning pin passes through the upper spacer, the center hole on the planetary gear, the lower spacer and the curved hole of the steering switch to be inserted into the positioning hole.

2. The ratchet structure according to claim 1, wherein a first annular groove is provided in a toothed middle portion of the toothed shaft, the planetary gears are provided below the first annular groove, and a first snap ring fitted with and resisted against an upper end of the ratchet speed multiplier casing is provided inside the first annular groove.

3. The ratchet structure according to claim 1, wherein a second annular groove is provided at an end portion of a smooth segment of the toothed shaft, and a second snap ring fitted with and resisted against a lower end of the ratchet body is provided inside the second annular groove.

4. The ratchet structure according to claim 1, wherein the steering component has a disc-like upper portion, and a circular stepped groove for embedding the upper portion of the steering component is provided at an upper end of the curved cavity of the ratchet body; the positioning mechanism comprises a steel ball, a blind hole is formed on an outer surface of the disc-like upper portion of the steering component, and the steel ball is protruded from the blind hole and embedded on the steering component; two positioning grooves matched with the steel ball are provided on an inner wall of the circular stepped groove of the ratchet body, a spring which renders the steel ball always in an outward trend is provided between the bottom of the blind hole and the steel ball; and when the steering component is rotated and the steel ball is located in a positioning groove at a left side or a right side, the clamping column is tightly resisted against the toothed shaft, and the toothed shaft rotates in a single direction clockwisely or counterclockwisely respectively.

5. The ratchet structure according to claim 4, wherein the steering switch for controlling the rotation of the steering component is provided on the steering component, and wherein the steering switch has a ferrule-like structure, and the steering switch is sleeved outside the ratchet body to connect with the steering component.

6. The ratchet structure according to claim 5, wherein three sectored clamping holes are formed on an upper surface of the upper portion of the steering component, a clamping pin fitted with the sectored clamping hole is provided at and protruded from a lower end of the steering switch, and the steering switch is clamped with the steering component by the fitting between the clamping pin and the sectored clamping hole.

7. The ratchet structure according to claim 6, wherein an arrow mark for steering is provided on an outer side of the steering switch.

8. The ratchet structure according to claim 1, wherein a toothed upper end of the toothed shaft is connected to an extension rod in interference fit.

* * * * *